US011920577B1

(12) United States Patent
Rashidi

(10) Patent No.: US 11,920,577 B1
(45) Date of Patent: Mar. 5, 2024

(54) LUBE OIL REPLENISHMENT FOR COMPRESSORS

(71) Applicant: Saudi Arabian Oil Company, Dhahran (SA)

(72) Inventor: Talal H. Rashidi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/989,082

(22) Filed: Nov. 17, 2022

(51) Int. Cl.
*F04B 39/02* (2006.01)
*F01M 1/02* (2006.01)
*F01M 11/00* (2006.01)
*F01M 11/06* (2006.01)

(52) U.S. Cl.
CPC ..... *F04B 39/0292* (2013.01); *F01M 1/02* (2013.01); *F01M 11/061* (2013.01); *F04B 39/0207* (2013.01); *F04B 39/0276* (2013.01); *F01M 2011/0095* (2013.01)

(58) Field of Classification Search
CPC ..... F04B 39/0207; F04B 39/0276; F04B 39/0292; F04B 41/02; F04B 53/18; F01M 1/02; F01M 2011/0095; F01M 11/061
See application file for complete search history.

(56) References Cited

U.S. PATENT DOCUMENTS 3,500,962 A * 3/1970 Kocher ..... F04B 39/0207 62/468
2002/0023624 A1* 2/2002 Meisner ..... F02M 59/105 123/502
2014/0010670 A1* 1/2014 Donald ..... F04B 39/0207 417/437
2016/0177945 A1* 6/2016 Byrne ..... F04B 53/18 184/6
2020/0340375 A1* 10/2020 Dupays ..... F01M 1/16
2021/0040836 A1* 2/2021 Baskin ..... F04B 53/18
2021/0040945 A1* 2/2021 Hurst ..... F04B 49/08
2022/0268185 A1* 8/2022 Dewhurst ..... F01M 11/0408

FOREIGN PATENT DOCUMENTS

DE 3020487 A * 12/1980 ..... F01M 1/02

OTHER PUBLICATIONS

DE3020487A_t machine translation thereof (Year: 1980).*
"Technical Manual 9-834: Vehicular General Purpose Unit Equipment," US War Department, Jun. 1, 1944, 110 pages.
(Continued)

*Primary Examiner* — Abiy Teka
*Assistant Examiner* — Matthew Wiblin
(74) *Attorney, Agent, or Firm* — Fish & Richardson P.C.

(57) ABSTRACT

A first lube oil is stored by a lube oil reservoir. The first lube oil is flowed from the lube oil reservoir through a tubing network connected to a crankcase of a reciprocating compressor. A second lube oil is stored by a cylinder lubricator oil reservoir. The second lube oil is flowed from the cylinder lubricator oil reservoir to a cylinder lubricator that is connected to cylinders of the reciprocating compressor. A liquid level in the cylinder lubricator oil reservoir is measured. Based on the measured liquid level, at least a portion of the first lube oil from the tubing network is flowed to the cylinder lubricator oil reservoir through an intermediate flowline connecting the tubing network to the cylinder lubricator oil reservoir.

17 Claims, 3 Drawing Sheets

(56) References Cited

OTHER PUBLICATIONS

Mitianiec, "Analysis of the crankcase filling of a two-stroke engine with a volumetric intake system," Submitted in partial fulfilment of the requirements for the degree of PhD in Engineering to the Faculty of Mechanical Engineering at Gdansk University of Technology, May 1998, translated Aug. 2021, 179 pages.
Ogundele et al., "Maintenance of an Air Compressor Used in Quarries," Sch. J. Eng. Tech., 2014, 2(4C):621-627, 8 pages.

* cited by examiner

LUBE OIL REPLENISHMENT FOR COMPRESSORS

TECHNICAL FIELD

This disclosure relates to compressor maintenance.

BACKGROUND

A compressor is a mechanical device that increases the pressure of a gas by reducing its volume. Thus, compressors can facilitate transport of gases. Two main categories of compressors include positive displacement compressors and dynamic compressors. One example of a positive displacement compressor is a reciprocating compressor. Some examples of reciprocating compressors include diaphragm compressors, swash plate compressors, and linear compressors. Reciprocating compressors include pistons that are driven by a crankshaft. Reciprocating compressors include various areas that are lubricated for proper operation.

SUMMARY

This disclosure describes technologies relating to lube oil replenishment for compressors, and in particular, reciprocating compressors. Certain aspects of the subject matter described can be implemented as a method for providing lube oil to a reciprocating compressor. A first lube oil is flowed to a crankcase of the reciprocating compressor. Flowing the first lube oil to the crankcase includes storing, by a lube oil reservoir, the first lube oil. Flowing the first lube oil to the crankcase includes flowing the first lube oil from the lube oil reservoir through a tubing network connected to the crankcase. A second lube oil is flowed to cylinders of the reciprocating compressor. Flowing the second lube oil to the cylinders includes storing, by a cylinder lubricator oil reservoir, the second lube oil. Flowing the second lube oil to the cylinders includes flowing the second lube oil from the cylinder lubricator oil reservoir to a cylinder lubricator that is connected to the cylinders. A liquid level in the cylinder lubricator oil reservoir is measured. Based on the measured liquid level, at least a portion of the first lube oil from the tubing network is flowed to the cylinder lubricator oil reservoir through an intermediate flowline connecting the tubing network to the cylinder lubricator oil reservoir.

This, and other aspects, can include one or more of the following features. Flowing at least the portion of the first lube oil from the tubing network to the cylinder lubricator oil reservoir through the intermediate flowline can include flowing the portion of the first lube oil through at least one of a pressure regulator or a restriction orifice installed on the intermediate flowline, thereby reducing pressure of the portion of the first lube oil flowing from the tubing network through the intermediate flowline to the cylinder lubricator oil reservoir. For example, the pressure regulator or the restriction orifice can reduce the portion of the first lube oil flowing from the tubing network through the intermediate flowline to the cylinder lubricator oil reservoir to an operating pressure of about 5 pounds per square inch gauge (psig). The liquid level in the cylinder lubricator oil reservoir can be measured by a float controller disposed within the cylinder lubricator oil reservoir. The float controller can be floating on the liquid level in the cylinder lubricator oil reservoir. The measured liquid level can be compared with a specified low liquid level. An inlet valve can be coupled to the cylinder lubricator oil reservoir. The inlet valve can be opened in response to determining that the measured liquid level is less than or equal to the specified liquid level, thereby allowing the first lube oil from the tubing network to flow through the intermediate flowline and into the cylinder lubricator oil reservoir through the inlet valve that has opened. The measured liquid level can be compared with a specified normal liquid level. The inlet valve can be closed in response to determining that the measured liquid level has returned from the specified low liquid level to the specified normal liquid level, thereby ceasing flow of the first lube oil from the tubing network through the intermediate flowline and into the cylinder lubricator oil reservoir due to closing of the inlet valve. The measured liquid level can be compared with a specified high liquid level. An outlet valve can be coupled to the cylinder lubricator oil reservoir. The outlet valve can be opened in response to determining that the measured liquid level is greater than or equal to the specified high liquid level, thereby allowing the first lube oil, the second lube oil, or both to flow out of the cylinder lubricator oil reservoir via the outlet valve that has opened. The first lube oil, the second lube oil, or both can be flowed out of the cylinder lubricator oil reservoir via the outlet valve that has opened to the crankcase through an outlet flowline. The outlet flowline can connect the cylinder lubricator oil reservoir to the crankcase. A control valve can be installed on the intermediate flowline. The control valve can be opened in response to determining that the measured liquid level is less than or equal to the specified low liquid level, thereby allowing the first lube oil from the tubing network to flow through the intermediate flowline and into the cylinder lubricator oil reservoir via the control valve that has opened. The control valve can be closed in response to determining that the measured liquid level is greater than or equal to the specified high liquid level, thereby ceasing flow of the first lube oil from the tubing network through the intermediate flowline and into the cylinder lubricator oil reservoir due to closing of the control valve.

Certain aspects of the subject matter described can be implemented as a lube oil system configured to provide lube oil to a reciprocating compressor. The lube oil system includes a lube oil circulation system, a cylinder lubrication system, an intermediate flowline, and a control system. The lube oil circulation system includes a lube oil reservoir, a tubing network, and a lube oil pump. The lube oil reservoir is configured to store a first lube oil. The tubing network is connected to the lube oil reservoir. The tubing network is connected to a crankcase of the reciprocating compressor. The lube oil pump is configured to pump the first lube oil throughout the tubing network. The cylinder lubrication system includes a cylinder lubricator oil reservoir and a cylinder lubricator. The cylinder lubricator oil reservoir is configured to store a second lube oil. The cylinder lubricator is connected to the cylinder lubricator oil reservoir. The cylinder lubricator is connected to cylinders of the reciprocating compressor. The cylinder lubricator is configured to distribute the second lube oil to the cylinders. The intermediate flowline connects the lube oil circulation system to the cylinder lubrication system. The intermediate flowline connects the tubing network to the cylinder lubricator oil reservoir. The control system includes a level sensor. The level sensor is coupled to the cylinder lubricator oil reservoir. The level sensor is configured to measure a liquid level in the cylinder lubricator oil reservoir. The control system is configured to control flow of the first lube oil from the lube oil circulation system to the cylinder lubrication system through the intermediate flowline based on the liquid level in the cylinder lubricator oil reservoir measured by the level sensor.

This, and other aspects, can include one or more of the following features. The control system can include a flow element. The flow element can be installed on the intermediate flowline. The flow element can be configured to reduce pressure of the first lube oil flowing through the intermediate flowline. The flow element can include at least one of a pressure regulator or a restriction orifice. The level sensor can include a float controller. The float controller can be disposed within the cylinder lubricator oil reservoir. The float controller can float on the liquid level in the cylinder lubricator oil reservoir. The control system can include an inlet valve. The inlet valve can be coupled to the cylinder lubricator oil reservoir. The inlet valve can be coupled to the intermediate flowline. The float controller can be communicatively coupled to the inlet valve. The float controller can be configured to compare the liquid level in the cylinder lubricator oil reservoir measured by the level sensor with a specified low liquid level. The float controller can be configured to open the inlet valve in response to determining that the liquid level in the cylinder lubricator oil reservoir measured by the level sensor is less than or equal to the specified low liquid level, thereby allowing the first lube oil from the tubing network to flow through the intermediate flowline and into the cylinder lubricator oil reservoir through the inlet valve that has opened. The float controller can be configured to compare the liquid level in the cylinder lubricator oil reservoir measured by the level sensor with a specified normal liquid level. The float controller can be configured to close the inlet valve in response to determining that the liquid level in the cylinder lubricator oil reservoir measured by the level sensor has returned from the specified low liquid level to the specified normal liquid level, thereby ceasing flow of the first lube oil from the tubing network through the intermediate flowline and into the cylinder lubricator oil reservoir due to closing of the inlet valve. The control system can include an outlet flowline. The outlet flowline can be coupled to the cylinder lubricator oil reservoir. The outlet flowline can be coupled to the crankcase of the reciprocating compressor. The control system can include an outlet valve. The outlet valve can be coupled to the cylinder lubricator oil reservoir. The outlet valve can be coupled to the outlet flowline. The float controller can be communicatively coupled to the outlet valve. The float controller can be configured to compare the liquid level in the cylinder lubricator oil reservoir measured by the level sensor with a specified high liquid level. The float controller can be configured to open the outlet valve in response to determining that the liquid level in the cylinder lubricator oil reservoir measured by the level sensor is greater than or equal to the specified high liquid level, thereby allowing the first lube oil, the second lube oil, or both to flow out of the cylinder lubricator oil reservoir through the outlet flowline, via the outlet valve that has opened, to the crankcase of the reciprocating compressor. The control system can include a control valve. The control valve can be installed on the intermediate flowline. The control system can include a controller. The controller can be communicatively coupled to the level sensor. The controller can be communicatively coupled to the control valve. The controller can be configured to compare the liquid level in the cylinder lubricator oil reservoir measured by the level sensor with a specified low liquid level. The controller can be configured to transmit an open signal to the control valve to open the control valve in response to determining that the liquid level in the cylinder lubricator oil reservoir measured by the level sensor is less than or equal to the specified low liquid level, thereby allowing the first lube oil from the tubing network to flow through the intermediate flowline and into the cylinder lubricator oil reservoir via the control valve that has opened. The controller can be configured to compare the liquid level in the cylinder lubricator oil reservoir measured by the level sensor with a specified high liquid level. The controller can be configured to transmit a close signal to the control valve to close the control valve in response to determining that the liquid level in the cylinder lubricator oil reservoir measured by the level sensor is greater than or equal to the specified high liquid level, thereby ceasing flow of the first lube oil from the tubing network through the intermediate flowline and into the cylinder lubricator oil reservoir due to closing of the control valve. The control valve can be downstream of the flow element on the intermediate flowline. The control valve can be a first control valve. The control system can include a second control valve. The second control valve can be installed on the intermediate flowline downstream of the first control valve. The controller can be communicatively coupled to the second control valve. The controller can be configured to transmit the open signal to the second control valve along with transmitting the open signal to the first control valve to open the second control valve with the first control valve. The controller can be configured to transmit the close signal to the second control valve along with transmitting the close signal to the first control valve to close the second control valve with the first control valve.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1:
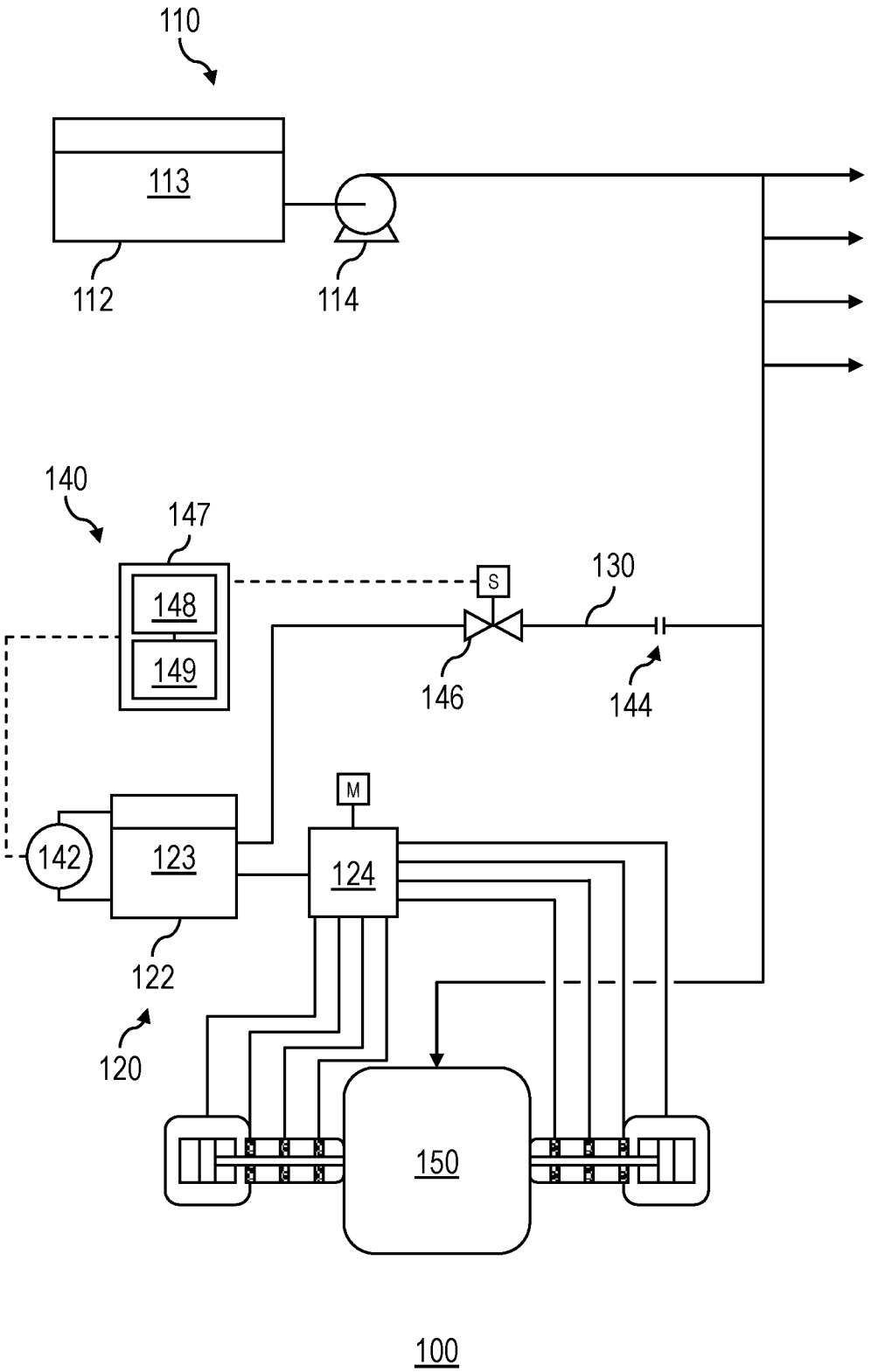
FIG. 1 is a schematic diagram of an example system for replenishing lube oil in reciprocating compressors.

This disclosure describes oil replenishment in reservoirs for reciprocating compressors. Reciprocating compressors include various areas that are lubricated for proper operation. Three examples of such areas that are lubricated include the crankcase, the packing (for example, oil wiper packing and pressure packing), and the cylinders. For the crankcase, various components such as the bearings, the bushings, the timing gears, and the crosshead guides are lubricated. For the cylinders, various components such as the cylinder walls, the piston rings, and the valves are lubricated. A lube oil circulation system provides lube oil to the crankcase. A lubricator provides lube oil to the packing and to the cylinders. The systems and processes described supply oil directly from the compressor crankcase oil reservoir to the lube oil reservoir for the cylinder lubricator. In some implementations, the lube oil reservoir for the cylinder lubricator is connected to the crankcase oil reservoir by a flow line that is supplied with a flow element (for example, a flow orifice or a control valve) and at least one solenoid valve that opens/closes based on a level reading in the lube oil reservoir. In some implementations, the lube oil reservoir for the cylinder lubricator is connected to the crankcase oil reservoir by a flow line that is supplied with a flow element based on a float controller detecting a fluid level in the lube oil reservoir. Overfill can be routed back to the crankcase.

Typical conventional reciprocating compressors use a cylinder lubricator pump to keep its cylinders lubricated. Cylinder lubricator pumps can require daily refills which are typically provided by a human operator. Whenever a human operator is involved, the risk of human error exists. In cases where the human operator forgets or accidentally skips refill of the cylinder lubricator pump, the compressor piston rings and/or cylinder liner can prematurely fail due to loss of lube oil. Such incidents involving damage to internal compressor components can lead to prolonged shutdown and, in turn, loss in revenue.

The subject matter described in this disclosure can be implemented in particular implementations, so as to realize one or more of the following advantages. The systems and methods described can provide a practical solution to supply lube oil to compressor cylinders, for example, by providing emergency lubrication to the moving parts of the cylinder pistons. The systems and methods described implement automatic refilling of the cylinder lubricator oil reservoir via a side stream from the compressor main lube oil circulation system based on detection of low lube oil level in the cylinder lubricator oil reservoir. The systems and methods described can be implemented to automatically supply lube oil to the cylinder lubricator oil reservoir by transferring a portion of the lube oil that circulates in the crankcase lube oil system. Thus, the systems and methods described can be implemented to mitigate and/or eliminate the risk of failure of normally lubricated parts of a reciprocating compressor (such as pistons, cylinder liners, and rider rings) due to loss of lube oil and low liquid level in the cylinder lubricator oil reservoir. The systems and methods described can prolong operating life of reciprocating compressors and can allow for longer run times in between maintenance activities, which can in turn reduce down time and improve productivity of the systems and processes that use such compressors. The systems and methods described can be implemented to add a layer of protection against failure of normally lubricated parts of a reciprocating compressor by protecting against human error (for example, operator forgetting to replenish lube oil in the cylinder lubricator oil reservoir).

FIG. 1 is a schematic diagram of an example lube oil system 100 configured to provide lube oil to a reciprocating compressor. The lube oil system 100 supplies lube oil to the reciprocating compressor as the reciprocating compressor pressurizes a process gas. The lube oil system 100 includes a lube oil circulation system 110, a cylinder lubrication system 120, an intermediate flowline 130, and a control system 140. The lube oil circulation system 110 includes a lube oil reservoir 112, a lube oil pump 114, and a tubing network 116. The lube oil reservoir 112 is configured to store a first lube oil 113. The tubing network 116 is connected to the lube oil reservoir 112. The tubing network 116 is connected to a crankcase 150 of the reciprocating compressor. The tubing network 116 is configured to connect the lube oil reservoir 112 to various components of the reciprocating compressor (such as the crankcase 150) such that the first lube oil 113 can be flowed to such components. For simplicity and clarity, the other components of the reciprocating compressor that are not directly related to the lube oil system 100 are not shown in FIG. 1. The lube oil pump 114 is configured to pump the first lube oil 113 from the lube oil reservoir 112 and throughout the tubing network 116.

The cylinder lubrication system 120 includes a cylinder lubricator oil reservoir 122 and a cylinder lubricator 124. The cylinder lubricator oil reservoir 122 is configured to store a second lube oil 123. The cylinder lubricator 124 is connected to the cylinder lubricator oil reservoir 122. The cylinder lubricator 124 is connected to the cylinders 152 of the reciprocating compressor. The cylinder lubricator 124 is configured to distribute the second lube oil 123 to the cylinders 152. In some implementations, the cylinder lubricator 124 is configured to distribute the second lube oil 123 to the crankshaft 154 of the reciprocating compressor.

The intermediate flowline 130 connects the lube oil circulation system 110 to the cylinder lubrication system 120. In some implementations, the intermediate flowline 130 connects the tubing network 116 to the cylinder lubricator oil reservoir 122. In some implementations, the first lube oil 113 and the second lube oil 123 have the same composition. In some implementations, the first lube oil 113 and the second lube oil 123 have different compositions. In some implementations, the first lube oil 113 and the second lube oil 123 have viscosities that are the same or substantially the same. For example, the viscosity of the first lube oil 113 is in a range of from 10% less to 10% greater than the viscosity of the second lube oil 123. In some implementations, both the first lube oil 113 and the second lube oil 123 are compatible with the process gas that is being pressurized by the reciprocating compressor.

The control system 140 includes a level sensor 142 that is coupled to the cylinder lubricator oil reservoir 122. The level sensor 142 is configured to measure a liquid level in the cylinder lubricator oil reservoir 122. The level sensor 142 can be, for example, a differential pressure level sensor (a level sensor that determines liquid level based on a pressure difference across a specified height) or a float level sensor (a level sensor that floats on the liquid and determines the liquid level based on the sensor rising and falling with the liquid level). The control system 140 is configured to control flow of the first lube oil 113 from the lube oil circulation system 110 (for example, from the tubing network 116) to the cylinder lubrication system 120 (for example, to the cylinder lubricator oil reservoir 122) through the intermediate flowline 130 based on the liquid level in the cylinder lubricator oil reservoir measured by the level sensor 142. The control system 140 can include a flow element 144 that is installed on the intermediate flowline 130. The flow element 144 is configured to reduce pressure of the first lube oil 113 flowing through the intermediate flowline 130. The flow element 144 can include a pressure regulator, a restriction orifice, or both. In some implementations, the flow element 144 is configured to maintain an operating pressure directly downstream of the flow element 144 of about 5 pounds per square inch gauge (psig). In some implementations, the flow element 144 is configured to maintain an operating pressure in the cylinder lubricator oil reservoir 122 of about 5 psig.

In some implementations, as shown in FIG. 1, the control system 140 includes a control valve 146 that is installed on the intermediate flowline 130. The control valve 146 can be, for example, a solenoid valve. In some implementations, the control system 140 includes a redundant control valve (not shown) that is installed on the intermediate flowline 130 and substantially the same as the control valve 146. In some implementations, the control system 140 includes multiple redundant control valves. The redundant control valve(s) behave in the same manner as the control valve 146. For example, the redundant control valve(s) open with the control valve 146 and close with the control valve 146. The redundant control valve(s) can be included for increased reliability, as including multiple valves can ensure that the intended result (closing or opening of the valves to shut off or allow flow, respectively) is realized even if one of the valves fails. In some implementations, the control valve 146 (and redundant control valve(s)) is located downstream of the flow element 144 on the intermediate flowline 130.

The control system 140 can include a controller 147 that is communicatively coupled to the level sensor 142 and to the control valve 146 (and to the redundant control valve(s) if the control system 140 includes such redundant control valve(s)). The level sensor 142 measures the liquid level in the cylinder lubricator oil reservoir 122 and transmits the measured liquid level to the controller 147. The controller 147 can be configured to compare the liquid level in the cylinder lubricator oil reservoir 122 measured by the level sensor 142 with a specified low liquid level. Under normal operation where the liquid level in the cylinder lubricator oil reservoir 122 is greater than the specified low liquid level, the control valve 146 (and redundant control valve(s)) are closed, so that the first lube oil 113 is not flowing from the lube oil circulation system 110 to the cylinder lubrication system 120 through the intermediate flowline 130. The controller 147 can be configured to transmit an open signal to the control valve 146 (and to the redundant control valve(s) if the control system 140 includes such redundant control valve(s)) to open the control valve 146 (and redundant control valve(s)) in response to determining that the liquid level in the cylinder lubricator oil reservoir 122 measured by the level sensor 142 is less than or equal to the specified low liquid level, thereby allowing the first lube oil 113 from the lube oil circulation system 110 (for example, from the tubing network 116) to flow through the intermediate flowline 130 and into the cylinder lubricator oil reservoir 122 via the control valve 146 that has opened. Thus, the control system 140 allows for lube oil to be transferred from the lube oil circulation system 110 to the cylinder lubrication system 120 in cases where lube oil needs to be replenished in the cylinder lubrication system 120.

In some implementations, the controller 147 is configured to compare the liquid level in the cylinder lubricator oil reservoir 122 measured by the level sensor 142 with a specified high liquid level and/or a specified normal liquid level. The controller 147 can be configured to transmit a close signal to the control valve 146 (and redundant control valve(s)) in response to determining that the liquid level in the cylinder lubricator oil reservoir 122 measured by the level sensor 142 is greater than or equal to the specified high liquid level or the specified normal liquid level, thereby ceasing flow of the first lube oil 113 from the lube oil circulation system 110 (for example, from the tubing network 116) to flow through the intermediate flowline 130 and into the cylinder lubricator oil reservoir 122 due to closing of the control valve 146 (and redundant control valve(s)). Thus, the control system 140 can cease supply of lube oil from the lube oil circulation system 110 to the cylinder lubrication system 120 once a sufficient amount of lube oil is available in the cylinder lubrication system 120.

The controller 147 can include one or more processors 148 and a non-transitory computer-readable storage medium (memory) 149. The processor 148 may be a microprocessor, a multi-core processor, a multithreaded processor, an ultra-low-voltage processor, an embedded processor, or a virtual processor. In some implementations, the processor 148 may be part of a system-on-a-chip (SoC) in which the processor 148 and the other components of the controller 147 are formed into a single integrated electronics package. In some implementations, the processor 148 may include processors from Intel® Corporation of Santa Clara, California, from Advanced Micro Devices, Inc. (AMD) of Sunnyvale, California, or from ARM Holdings, LTD., Of Cambridge, England. Any number of other processors from other suppliers may also be used. Generally, the processor 148 executes instructions and manipulates data to perform the operations of the controller 147 and any algorithms, methods, functions, processes, flows, and procedures as described in this specification. The processor 148 may communicate with other components of the controller 147 over a bus. The bus may include any number of technologies, such as industry standard architecture (ISA), extended ISA (EISA), peripheral component interconnect (PCI), peripheral component interconnect extended (PCIx), PCI express (PCIe), or any number of other technologies. The bus may be a proprietary bus, for example, used in an SoC based system. Other bus technologies may be used, in addition to, or instead of, the technologies above.

The memory 149 is coupled to the one or more processors 148 and stores programming instructions for execution by the one or more processors 148. The programming instructions instruct the one or more processors 148 to perform operations, such as comparing the liquid level measured by the level sensor 142 to a specified liquid level (for example, low liquid level, normal liquid level, or high liquid level) and transmit an open signal or a close signal to a valve (such as the control valve 146) based on the measured liquid level. The memory 149 can hold data for the controller 147 or other components (or a combination of both) that can be connected to the network. While memory 149 is illustrated as an integral component of the controller 147, the memory 149 can be external to the controller 147. The memory 149 can be a transitory or non-transitory storage medium. In some implementations, such as in PLCs and other process control units, the memory 149 is integrated with a database used for long-term storage of programs and data. The memory 149 can include any number of volatile and non-volatile memory devices, such as volatile random-access memory (RAM), static random-access memory (SRAM), flash memory, and the like. In smaller devices, such as PLCs, the memory 149 may include registers associated with the processor 148 itself.

Figure 2:
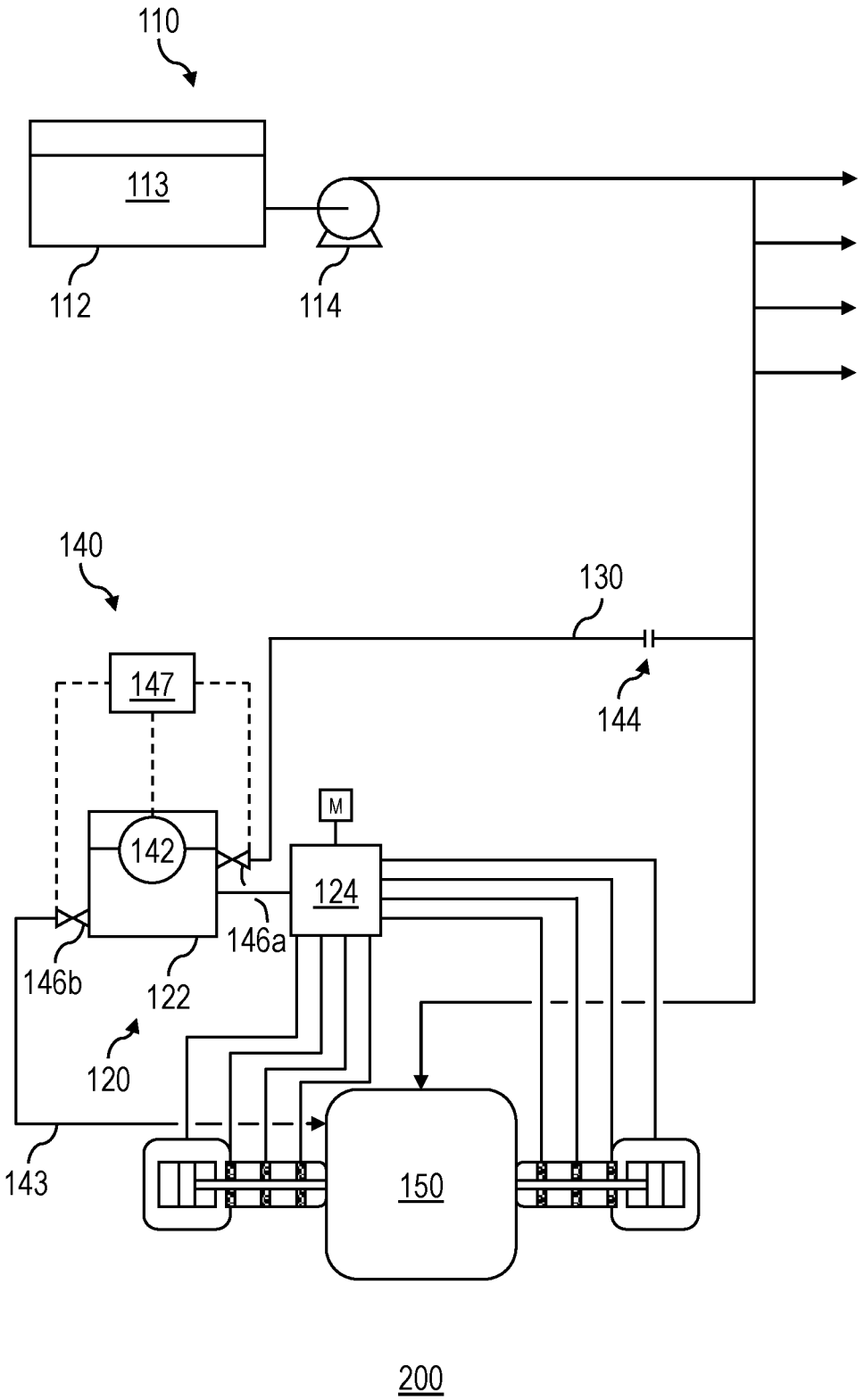
FIG. 2 is a schematic diagram of an example system for replenishing lube oil in reciprocating compressors.

FIG. 2 is a schematic diagram of an example system 200 for replenishing lube oil in reciprocating compressors. The system 200 can be substantially similar to the system 100 shown in FIG. 1. In some implementations, as shown in FIG. 2, the control valve 146 is omitted from the control system 140, and the control system 140 includes an inlet valve **146*a* and an outlet valve 146*b* that are coupled to the cylinder lubricator oil reservoir 122. The inlet valve 146*a* can be coupled to the intermediate flowline 130. In some implementations, the control system 140 includes an outlet flowline 143 that is coupled to the cylinder lubricator oil reservoir 122 via the outlet valve 146*b*. The outlet flowline 143 can be coupled to the crankcase 150** of the reciprocating compressor.

In some implementations, as shown in FIG. 2, the level sensor 142 is a float controller that includes a float level sensor communicatively coupled to the controller 147 (which includes the processor 148 and the memory 149 shown in FIG. 1 and described previously, but not shown in FIG. 2). In such implementations, at least a portion of the level sensor 142 floats on the liquid level in the cylinder lubricator oil reservoir 122. The float controller can be a mechanical float controller or an electrical float controller. The controller 147 can be communicatively coupled to the inlet valve 146*a* and the outlet valve 146*b*. Although shown in FIG. 2 as a float controller, the level sensor 142 can optionally be a differential pressure level sensor, similar to the implementation of the level sensor 142 shown in FIG. 1.

The controller 147 can be configured to compare the liquid level in the cylinder lubricator oil reservoir 122 measured by the level sensor 142 with a specified low liquid level. The controller 147 can be configured to transmit an open signal to the inlet valve 146*a* to open the inlet valve 146*a* in response to determining that the liquid level in the cylinder lubricator oil reservoir 122 measured by the level sensor 142 is less than or equal to the specified low liquid level, thereby allowing the first lube oil 113 from the lube oil circulation system 110 (for example, from the tubing network 116) to flow through the intermediate flowline 130 and into the cylinder lubricator oil reservoir 122 via the inlet valve 146*a* that has opened. The controller 147 can be configured to compare the liquid level in the cylinder lubricator oil reservoir 122 measured by the level sensor 142 with a specified normal liquid level. The controller 147 can be configured to transmit a close signal to the inlet valve 146*b* to close the inlet valve 146*b* in response to determining that the liquid level in the cylinder lubricator oil reservoir 122 measured by the level sensor 142 has returned from the specified low liquid level to the specified normal liquid level, thereby ceasing flow of the first lube oil 113 from the lube oil circulation system 110 (for example, from the tubing network) through the intermediate flowline 130 and into the cylinder lubricator oil reservoir 122 due to closing of the inlet valve 146*a*. The controller 147 can be configured to compare the liquid level in the cylinder lubricator oil reservoir 122 measured by the level sensor 142 with a specified high liquid level. The controller 147 can be configured to transmit an open signal to the outlet valve 146*b* to open the outlet valve 146*b* in response to determining that the liquid level in the cylinder lubricator oil reservoir 122 measured by the level sensor 142 is greater than or equal to the specified high liquid level, thereby allowing the first lube oil 113, the second lube oil 123, or both to flow out of the cylinder lubricator oil reservoir 122 through the outlet flowline 143, via the outlet valve 146*b* that has opened, to the crankcase 150 of the reciprocating compressor. In such implementations, the first lube oil 113 and the second lube oil 123 are both compatible with the process gas that is being pressurized by the reciprocating compressor, such that there is no harm to the system or risk of danger if the first lube oil 113, the second lube oil 123, or both come into contact with the process gas (for example, due to a leak).

Figure 3:
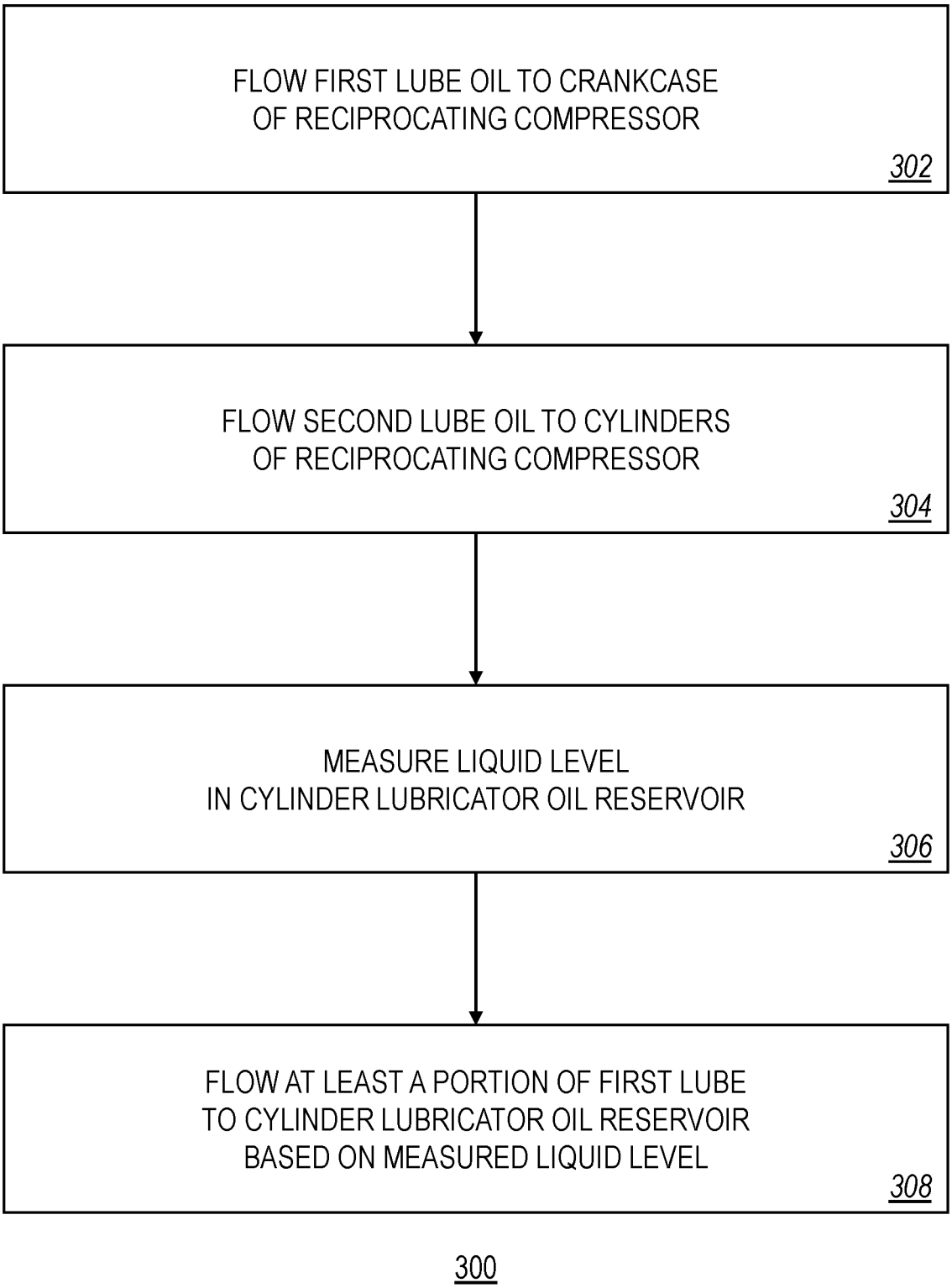
FIG. 3 is a flow chart of an example method for replenishing lube oil in reciprocating compressors.

FIG. 3 is a flow chart of an example method 300 for providing lube oil to a reciprocating compressor. Any of the system 100 or 200 can, for example, implement method 300. For simplicity and clarity, the description of the method 300 in this paragraph is described in relation to system 100 (although system 200 can optionally be used instead). At block 302, a first lube oil (such as the first lube oil 113) is flowed to a crankcase (such as the crankcase 150) of the reciprocating compressor. Flowing the first lube oil 113 to the crankcase 150 at block 302 includes storing, by a lube oil reservoir (such as the lube oil reservoir 112), the first lube oil 113. Flowing the first lube oil 113 to the crankcase 150 at block 302 includes flowing (for example, by the lube oil pump 114) the first lube oil 113 from the lube oil reservoir 112 through a tubing network (such as the tubing network 116) that is connected to the crankcase 150. Block 302 can, for example, be implemented by the lube oil circulation system 110. At block 304, a second lube oil (such as the second lube oil 123) is flowed to the cylinders (such as the cylinders 152) of the reciprocating compressor. Flowing the second lube oil 123 to the cylinders 152 at block 304 includes storing, by a cylinder lubricator oil reservoir (such as the cylinder lubricator oil reservoir 122), the second lube oil 123. Flowing the second lube oil 123 to the cylinders 152 at block 304 includes flowing the second lube oil 123 from the cylinder lubricator oil reservoir 122 to a cylinder lubricator (such as the cylinder lubricator 124) that is connected to the cylinders 152. The cylinder lubricator 124 can direct the second lube oil 123 to the cylinders 152. Block 304 can, for example, be implemented by the cylinder lubrication system 120. At block 306, a liquid level in the cylinder lubricator oil reservoir 122 is measured (for example, by the level sensor 142). At block 308, at least a portion of the first lube oil 113 is flowed from the tubing network 116 to the cylinder lubricator oil reservoir 122 through an intermediate flowline (such as the intermediate flowline 130) based on the liquid level measured at block 306. As described previously, the intermediate flowline 130 can connect the tubing network 116 to the cylinder lubricator oil reservoir 122. Blocks 306 and 308 can, for example, be implemented by the control system 140. In some implementations, flowing at least a portion of the first lube oil 113 from the tubing network 116 to the cylinder lubricator oil reservoir 122 at block 308 includes flowing the portion of the first lube oil 113 through the flow element 144 (which can include a pressure regulator, a restriction orifice, or both) that is installed on the intermediate flowline 130, thereby reducing pressure of the portion of the first lube oil 113 flowing from the tubing network 116 through the intermediate flowline 130 to the cylinder lubricator oil reservoir 122.

In some implementations, the method 200 includes comparing the measured liquid level with a specified low liquid level. In some implementations, the method 200 includes opening a control valve (such as the control valve 146 of the system 100 shown in FIG. 1) installed on the intermediate flowline 130 in response to determining that the measured liquid level is less than or equal to the specified low liquid level, thereby allowing the first lube oil 113 from the tubing network 116 to flow through the intermediate flowline 130 and into the cylinder lubricator oil reservoir 122 via the control valve 146 that has opened. In some implementations, the method 200 includes comparing the measured liquid level with a specified high liquid level. In some implementations, the method 200 includes closing the control valve 146 in response to determining that the measured liquid level is greater than or equal to the specified high liquid level, thereby ceasing flow of the first lube oil 113 from the tubing network 116 through the intermediate flowline 130 and into the cylinder lubricator oil reservoir 122 due to closing of the control valve 146.

In some implementations, the liquid level in the cylinder lubricator oil reservoir 122 is measured by a float controller disposed within the cylinder lubricator oil reservoir 122 and floating on the liquid level in the cylinder lubricator oil reservoir 122 (an example is provided by the system 200 shown in FIG. 2). In some implementations, the method 200 includes comparing the measured liquid level with a specified low liquid level. In some implementations, the method 200 includes opening an inlet valve (such as the inlet valve 146*a* of the system 200 shown in FIG. 2) coupled to the cylinder lubricator oil reservoir 122 in response to determining that the measured liquid level is less than or equal to the specified liquid level, thereby allowing the first lube oil 113 from the tubing network 116 to flow through the intermediate flowline 130 and into the cylinder lubricator oil reservoir 122 through the inlet valve 146*a* that has opened.

In some implementations, the method 200 includes comparing the measured liquid level with a specified normal liquid level. In some implementations, the method 200 includes closing the inlet valve 146*a* in response to determining that the measured liquid level has returned from the specified low liquid level to the specified normal liquid level, thereby ceasing flow of the first lube oil 113 from the tubing network 116 through the intermediate flowline 130 and into the cylinder lubricator oil reservoir 122 due to closing of the inlet valve 146*a*. In some implementations, the method 200 includes comparing the measured liquid level with a specified high liquid level. In some implementations, the method 200 includes opening an outlet valve (such as the outlet valve 146*b* of the system 200 shown in FIG. 2) coupled to the cylinder lubricator oil reservoir 122 in response to determining that the measured liquid level is greater than or equal to the specified high liquid level, thereby allowing the first lube oil 113, the second lube oil 123, or both to flow out of the cylinder lubricator oil reservoir 122 via the outlet valve 146*b* that has opened. In some implementations, the method 200 includes flowing the first lube oil 113, the second lube oil 123, or both out of the cylinder lubricator oil reservoir 122 via the outlet valve 146*b* that has opened to the crankcase 150 through an outlet flowline (such as the outlet flowline 143) connecting the cylinder lubricator oil reservoir 122 to the crankcase 150.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

flowing a first lube oil into a crankcase of a reciprocating compressor, wherein flowing the first lube oil to the crankcase comprises:

storing, by a lube oil reservoir, the first lube oil; and flowing the first lube oil from the lube oil reservoir through a tubing network connected to the crankcase;

flowing a second lube oil to a plurality of cylinders of the reciprocating compressor, wherein flowing the second lube oil to the plurality of cylinders comprises:

storing, by a cylinder lubricator oil reservoir, the second lube oil; and flowing the second lube oil from the cylinder lubricator oil reservoir to a cylinder lubricator that is connected to the plurality of cylinders;

measuring a liquid level in the cylinder lubricator oil reservoir; and flowing, based on the measured liquid level, at least a portion of the first lube oil from the tubing network to the cylinder lubricator oil reservoir through an intermediate flowline connecting the tubing network to the cylinder lubricator oil reservoir, wherein flowing at least the portion of the first lube oil from the tubing network to the cylinder lubricator oil reservoir through the intermediate flowline comprises flowing the portion of the first lube oil through at least one of a pressure regulator or a restriction orifice installed on the intermediate flowline, thereby reducing pressure of the portion of the first lube oil flowing from the tubing network through the intermediate flowline to the cylinder lubricator oil reservoir.

2. The method of claim 1, wherein the liquid level in the cylinder lubricator oil reservoir is measured by a float controller disposed within the cylinder lubricator oil reservoir and floating on the liquid level in the cylinder lubricator oil reservoir.

3. The method of claim 2, comprising:

comparing the measured liquid level with a specified low liquid level; and opening an inlet valve coupled to the cylinder lubricator oil reservoir in response to determining that the measured liquid level is less than or equal to the specified liquid level, thereby allowing the first lube oil from the tubing network to flow through the intermediate flowline and into the cylinder lubricator oil reservoir through the inlet valve that has opened.

4. The method of claim 3, comprising:

comparing the measured liquid level with a specified normal liquid level; and closing the inlet valve in response to determining that the measured liquid level has returned from the specified low liquid level to the specified normal liquid level, thereby ceasing flow of the first lube oil from the tubing network through the intermediate flowline and into the cylinder lubricator oil reservoir due to closing of the inlet valve.

5. The method of claim 4, comprising:

comparing the measured liquid level with a specified high liquid level; and opening an outlet valve coupled to the cylinder lubricator oil reservoir in response to determining that the measured liquid level is greater than or equal to the specified high liquid level, thereby allowing the first lube oil, the second lube oil, or both to flow out of the cylinder lubricator oil reservoir via the outlet valve that has opened.

6. The method of claim 5, comprising flowing the first lube oil, the second lube oil, or both out of the cylinder lubricator oil reservoir via the outlet valve that has opened to the crankcase through an outlet flowline connecting the cylinder lubricator oil reservoir to the crankcase.

7. The method of claim 1, comprising:

comparing the measured liquid level with a specified low liquid level; and opening a control valve installed on the intermediate flowline in response to determining that the measured liquid level is less than or equal to the specified low liquid level, thereby allowing the first lube oil from the tubing network to flow through the intermediate flowline and into the cylinder lubricator oil reservoir via the control valve that has opened.

8. The method of claim 7, comprising:

comparing the measured liquid level with a specified high liquid level; and closing the control valve in response to determining that the measured liquid level is greater than or equal to the specified high liquid level, thereby ceasing flow of the first lube oil from the tubing network through the intermediate flowline and into the cylinder lubricator oil reservoir due to closing of the control valve.

9. A lube oil system comprising:

a reciprocating compressor comprising a crankcase;

a lube oil circulation system comprising:

a lube oil reservoir configured to store a first lube oil;

a tubing network connected to the lube oil reservoir and to the crankcase of the reciprocating compressor; and a lube oil pump configured to pump the first lube oil throughout the tubing network;

a cylinder lubrication system comprising:

a cylinder lubricator oil reservoir configured to store a second lube oil; and a cylinder lubricator connected to the cylinder lubricator oil reservoir and to a plurality of cylinders of the reciprocating compressor, the cylinder lubricator configured to distribute the second lube oil to the plurality of cylinders;

an intermediate flowline connecting the tubing network of the lube oil circulation system to the cylinder lubricator oil reservoir of the cylinder lubrication system;

a control system comprising a level sensor coupled to the cylinder lubricator oil reservoir, the level sensor configured to measure a liquid level in the cylinder lubricator oil reservoir, the control system configured to control flow of the first lube oil from the lube oil circulation system to the cylinder lubrication system through the intermediate flowline based on the liquid level in the cylinder lubricator oil reservoir measured by the level sensor wherein the control system comprises a flow element installed on the intermediate flowline, the flow element configured to reduce pressure of the first lube oil flowing through the intermediate flowline, the flow element comprising at least one of a pressure regulator or a restriction orifice.

10. The lube oil system of claim 9, wherein the level sensor comprises a float controller disposed within the cylinder lubricator oil reservoir and floating on the liquid level in the cylinder lubricator oil reservoir.

11. The lube oil system of claim 10, wherein:

the control system comprises an inlet valve coupled to the cylinder lubricator oil reservoir and to the intermediate flowline;

the float controller is communicatively coupled to the inlet valve;

the float controller is configured to compare the liquid level in the cylinder lubricator oil reservoir measured by the level sensor with a specified low liquid level;

the float controller is configured to open the inlet valve in response to determining that the liquid level in the cylinder lubricator oil reservoir measured by the level sensor is less than or equal to the specified low liquid level, thereby allowing the first lube oil from the tubing network to flow through the intermediate flowline and into the cylinder lubricator oil reservoir through the inlet valve that has opened.

12. The lube oil system of claim 11, wherein the float controller is configured to compare the liquid level in the cylinder lubricator oil reservoir measured by the level sensor with a specified normal liquid level, and the float controller is configured to close the inlet valve in response to determining that the liquid level in the cylinder lubricator oil reservoir measured by the level sensor has returned from the specified low liquid level to the specified normal liquid level, thereby ceasing flow of the first lube oil from the tubing network through the intermediate flowline and into the cylinder lubricator oil reservoir due to closing of the inlet valve.

13. The lube oil system of claim 12, wherein the control system comprises:

an outlet flowline coupled to the cylinder lubricator oil reservoir and to the crankcase of the reciprocating compressor; and an outlet valve coupled to the cylinder lubricator oil reservoir and to the outlet flowline, wherein the float controller is communicatively coupled to the outlet valve, wherein the float controller is configured to compare the liquid level in the cylinder lubricator oil reservoir measured by the level sensor with a specified high liquid level, wherein the float controller is configured to open the outlet valve in response to determining that the liquid level in the cylinder lubricator oil reservoir measured by the level sensor is greater than or equal to the specified high liquid level, thereby allowing the first lube oil, the second lube oil, or both to flow out of the cylinder lubricator oil reservoir through the outlet flowline, via the outlet valve that has opened, to the crankcase of the reciprocating compressor.

14. The lube oil system of claim 9, wherein the control system comprises:

a control valve installed on the intermediate flowline; and a controller communicatively coupled to the level sensor and to the control valve, wherein the controller is configured to compare the liquid level in the cylinder lubricator oil reservoir measured by the level sensor with a specified low liquid level, and the controller is configured to transmit an open signal to the control valve to open the control valve in response to determining that the liquid level in the cylinder lubricator oil reservoir measured by the level sensor is less than or equal to the specified low liquid level, thereby allowing the first lube oil from the tubing network to flow through the intermediate flowline and into the cylinder lubricator oil reservoir via the control valve that has opened.

15. The lube oil system of claim 14, wherein the controller is configured to compare the liquid level in the cylinder lubricator oil reservoir measured by the level sensor with a specified high liquid level, and the controller is configured to transmit a close signal to the control valve to close the control valve in response to determining that the liquid level in the cylinder lubricator oil reservoir measured by the level sensor is greater than or equal to the specified high liquid level, thereby ceasing flow of the first lube oil from the tubing network through the intermediate flowline and into the cylinder lubricator oil reservoir due to closing of the control valve.

16. The lube oil system of claim 15, wherein the control valve is downstream of the flow element on the intermediate flowline.

17. The lube oil system of claim 16, wherein:

the control valve is a first control valve;

the control system comprises a second control valve installed on the intermediate flowline downstream of the first control valve;

the controller is communicatively coupled to the second control valve;

the controller is configured to transmit the open signal to the second control valve along with transmitting the open signal to the first control valve to open the second control valve with the first control valve; and the controller is configured to transmit the close signal to the second control valve along with transmitting the close signal to the first control valve to close the second control valve with the first control valve.

* * * * *